US007426351B2

(12) United States Patent
Yamaguchi et al.

(10) Patent No.: US 7,426,351 B2
(45) Date of Patent: Sep. 16, 2008

(54) IMAGE FORMING APPARATUS AND LAYER THICKNESS CALCULATING METHOD

(75) Inventors: Hidehiko Yamaguchi, Kanagawa (JP); Chikaho Ikeda, Kanagawa (JP); Hideki Moriya, Kanagawa (JP); Masao Ohmori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 245 days.

(21) Appl. No.: 11/484,647

(22) Filed: Jul. 12, 2006

(65) Prior Publication Data

US 2007/0147856 A1 Jun. 28, 2007

(30) Foreign Application Priority Data

Dec. 26, 2005 (JP) ..... P2005-371884

(51) Int. Cl.
*G03G 15/00* (2006.01)

(52) U.S. Cl. ..... 399/26; 399/50

(58) Field of Classification Search ..... 399/9, 399/24, 26, 50, 66, 310, 311, 313
See application file for complete search history.

(56) References Cited

U.S. PATENT DOCUMENTS 5,159,388 A * 10/1992 Yoshiyama et al. ..... 399/26
5,160,967 A * 11/1992 Tonegawa ..... 399/26
5,943,526 A * 8/1999 Kodama ..... 399/66
6,738,586 B2 * 5/2004 Kubota et al. ..... 399/48
7,164,868 B2 * 1/2007 Ishida ..... 399/49
2007/0166057 A1 * 7/2007 Moriya et al. ..... 399/26

FOREIGN PATENT DOCUMENTS

JP 5-223513 8/1993

* cited by examiner

*Primary Examiner*—Hoan H Tran
(74) *Attorney, Agent, or Firm*—Morgan, Lewis & Bockius LLP

(57) ABSTRACT

An image forming apparatus, includes: an image carrier that carries a developer image by a charge layer provided on a surface of the image carrier; a charger that charges the image carrier; a feeder that feeds the charger with a charge; a total charge amount detector that detects the total amount of the charge output by the feeder; an unsupplied charge amount calculator that calculates the amount of the charge output by the feeder but not supplied to the charger; and a layer thickness calculator that calculates the thickness of the charge layer based on the unsupplied charge amount calculated by the unsupplied charge amount calculator and the total charge amount detected by the total charge amount detector.

7 Claims, 9 Drawing Sheets

IMAGE FORMING APPARATUS AND LAYER THICKNESS CALCULATING METHOD

BACKGROUND

1. Technical Field

The present invention relates to an image forming apparatus having an image carrier that is charged to carry a developer image and a layer thickness calculating method for such an image forming apparatus.

2. Related Art

In an image forming apparatus having a photosensitive member that is charged to carry a toner image, a charge layer formed on the surface of the photosensitive member is worn out as it is contacted for example by a charger roll, a developing roll, and a cleaning blade. In the image forming apparatus of this kind, as the charge layer of the photosensitive member is worn out, the picture quality of an output image is lowered.

SUMMARY

According to an aspect of the invention, an image forming apparatus is provided including: an image carrier that carries a developer image by a charge layer provided on a surface of the image carrier; a charger that charges the image carrier; a feeder that feeds the charger with a charge; a total charge amount detector that detects the total amount of the charge output by the feeder; an unsupplied charge amount calculator that calculates the amount of the charge output by the feeder but not supplied to the charger; and a layer thickness calculator that calculates the thickness of the charge layer based on the unsupplied charge amount calculated by the unsupplied charge amount calculator and the total charge amount detected by the total charge amount detector.

BRIEF DESCRIPTION OF THE DRAWINGS

Exemplary embodiments of the present invention will be described in detail based on the following figures, wherein.

DETAILED DESCRIPTION

Now, an exemplary embodiment of the invention will be described with reference to the accompanying drawings.

Figure 1:
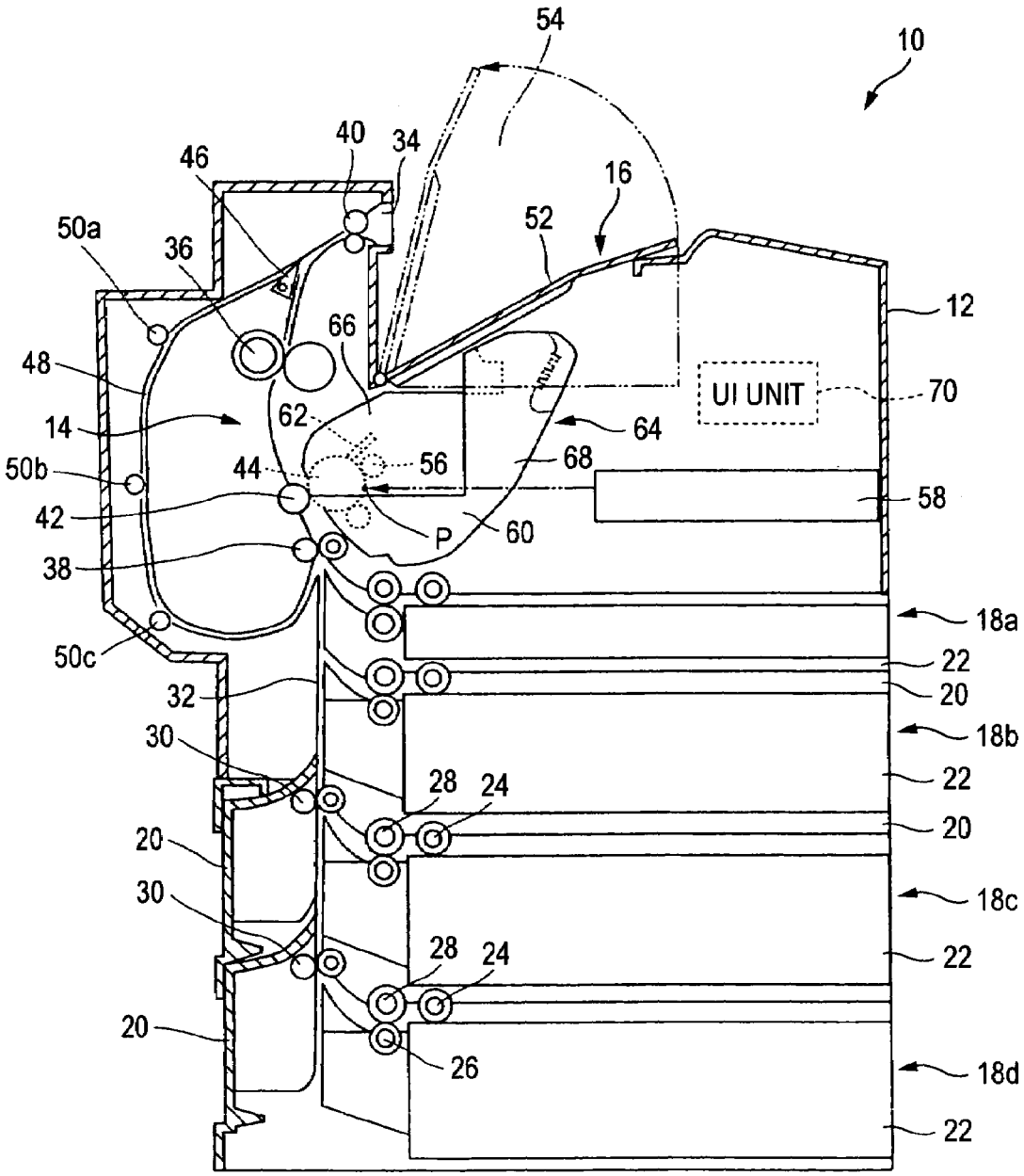
FIG. 1 is a side view of an image forming apparatus according to an exemplary embodiment of the invention.

FIG. 1 shows a general view of an image forming apparatus 10 according to the exemplary embodiment of the invention. The image forming apparatus 10 has an image forming apparatus main body 12 in which image former 14 is provided. A discharge unit 16 (described later) is provided at the upper part of the image forming apparatus main body 12 and two stages of paper feeding units, for example, units 18*a* and 18*b* are provided at the lower part of the image forming apparatus main body 12. Two stages of detachable paper feeding units 18*c* and 18*d* are provided as an option at the lower part of the image forming apparatus main body 12.

The paper feeding units 18*a* to 18*d* each include a paper feeding unit main body 20 and a paper feeding cassette 22 that stores paper sheets. The paper feeding cassette 22 is mounted slidably to the paper feeding unit main body 20 and drawn toward the front (to the right in FIG. 1). The paper feeding roll 24 is provided at the upper part of the paper feeding cassette 22 near the back end, and a retard roll 26 and a nudger roll 28 are provided in front of the paper feeding roll 24. The optional paper feeding units 18*c* and 18*d* are each provided with a feeding roll 30 to be paired therewith.

A transport path 32 serves as a paper passage from the feeding roll 30 of the lowermost paper feeding unit 18*d* to a discharge outlet 34. The transport path 32 has a part positioned in the vicinity of the back surface (the left side surface in FIG. 1) of the image forming apparatus main body 12 and formed approximately in the vertical direction from the feeding roll 30 of the lowermost paper feeding unit 18*d* to a fixing device 36 that will be described. A transfer device 42 and an image carrier 44 that will be described later are provided on the upstream side of the fixing device 36 in the transport path 32 and a resist roll 38 is provided on the upper stream side of the transfer device 42 and the image carrier 44. A discharge roll 40 is provided near the discharge outlet 34 in the transport path 32.

Therefore, a recording medium fed from a paper feeding cassette 22 of any of the paper feeding units 18*a* to 18*d* through the paper feeding roll 24 is sorted by the retard roll 26 and the nudger roll 28, guided into the transport path 32, temporarily stopped by the resist roll 38, and then a developer image is transferred on the medium as the medium is passed between the transfer device 42 and the image carrier 44 in adjusted timing. The transferred developer image is fixed by the fixing device 36 and then the medium is discharged from the discharge outlet 34 onto the discharge unit 16 by the discharge roll 40.

When however duplex printing is carried out, the medium is returned to a reverse path. More specifically, the transport path 32 is divided into two paths before the discharge roll 40. A switch claw 46 is provided at the branch position, and the reverse path 48 is formed from the branch position back to the resist roll 38. The reverse path 48 is provided with transport rolls 50*a* to 50*c*. For duplex printing, the switch claw 46 is switched to the side to open the reverse path 48, so that the discharge roll 40 is reversed at the point when the tip of the rear end of the recording medium touches the discharge roll 40. The recording medium is then guided to the reverse path 48, then passed through the resist roll 38, the transfer device 42, the image carrier 44, and the fixing device 36, and then discharged onto the discharge unit 16 from the discharge outlet 34.

The discharge unit 16 has an inclined part 52 pivotable with respect to the image forming apparatus main body. The position of the discharge outlet of the inclined part 52 is low and gradually increases in height towards the front side (to the right in FIG. 1). The end at the discharge outlet is a lower end, and the end at the high level is an upper end. The inclined part 52 is supported by the image forming apparatus main body 12 so that it can pivot around the lower end. As denoted by the double-dotted line in FIG. 1, when the inclined part 52 is turned and lifted upwardly, an opening 54 forms. Then a process cartridge 64 (that will be described later) can be attached/detached through the opening 54.

The image former 14 is for example an electro-photographic type device and includes an image carrier 44 made of a photosensitive member, a charger roll 56 that homogeneously charges the image carrier 44 by pressure-contacting, an optical writing device 58 that optically writes a latent image to the image carrier 44 charged by the charger roll 56, a developing device 60 that converts the latent image on the image carrier 44 formed by the optical writing device 58 into a visible image with a developer, a transfer device 42 (for example a transfer roll) that transfers the developer image by the developing device 60 onto paper, a cleaning device 62 (for example a blade) that cleans the developer remaining on the image carrier 44, and a fixing device 36 including a pressure roll and a heating roll that fixes the developer image on the paper transferred by the transfer device 42 thereon. The optical writing device 58 is made for example of a scanning type laser exposure device that is provided parallel to the paper feeding units 18*a* to 18*d* and near the front side of the image forming apparatus main body 12, and exposes the image carrier 44 to light across the developing device 60. The exposure position of the image carrier 44 is the latent image writing position P. Note that according to this exemplary embodiment, the scanning type laser exposure device is employed as the optical writing device 58, but a device such as an LED and a surface emitting laser may be employed in other exemplary embodiments.

The process cartridge 64 includes the image carrier 44, the charger roll 56, the developing device 60, and the cleaning device 62 in an integral form. The process cartridge 64 is provided immediately below the inclined part 52 of the discharge unit 16, and is detached/attached through the opening 54 that forms when the inclined part 52 is opened as described above.

The process cartridge 64 is detachable into an image carrier charging unit 66 including the image carrier 44, the charger roll 56, and the cleaning device 62, and a developing device unit 68 including the developing device 60.

A user interface (UI) unit 70 such as a touch panel is provided at the outer surface of the image forming apparatus main body 12. The UI unit 70 receives an input such as an instruction by the user and also indicates the result of processing by the image forming apparatus 10.

Figure 2:
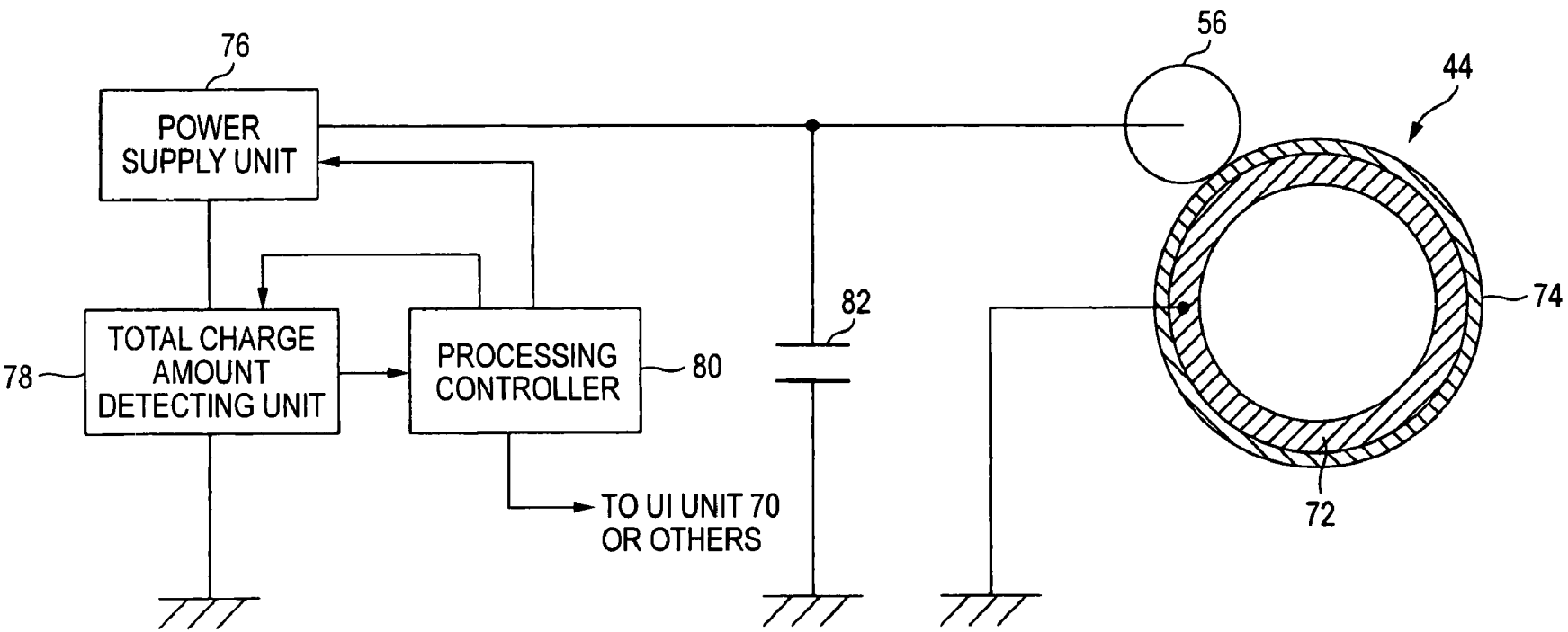
FIG. 2 is a block diagram showing in detail an image carrier, a charger roll, and their periphery.

FIG. 2 shows in detail the image carrier 44, the charger roll 56, and their periphery.

The image carrier 44 includes a cylindrical drum 72 and a photosensitive layer 74 formed on the outer surface of the drum 72. The drum 72 is made of a conductor such as aluminum and is grounded. The photosensitive layer 74 is a layer made of an inorganic or organic photoconductor and charged by charge supplied from the charger roll 56.

The charger roll 56 charges the image carrier 44 by charge supplied from the power supply unit 76. The power supply unit 76 responds to control by the processing controller 80 to supply voltage having AC and DC components superposed to the charger roll 56. The total charge amount detecting unit 78 detects the total amount of charge output by the power supply unit 76 and outputs the data to the processing controller 80. The processing controller 80 includes a CPU and a memory that are not shown, calculates the thickness of the photosensitive layer 74 based on the total charge amount input from the total charge amount detecting unit 78 (that will be described in conjunction with FIG. 5), outputs the result of calculation to the UI unit 70 and the like, and controls the elements that form the image forming apparatus 10 such as the power supply unit 76 and the total charge amount detecting unit 78. The calculated thickness of the layer may be indicated by the UI unit 70.

The capacitive load 82 collectively represents the capacitive load between the power supply unit 76 and the charger roll 56, and the load capacitance previously known by measurement or the like.

Figure 3:
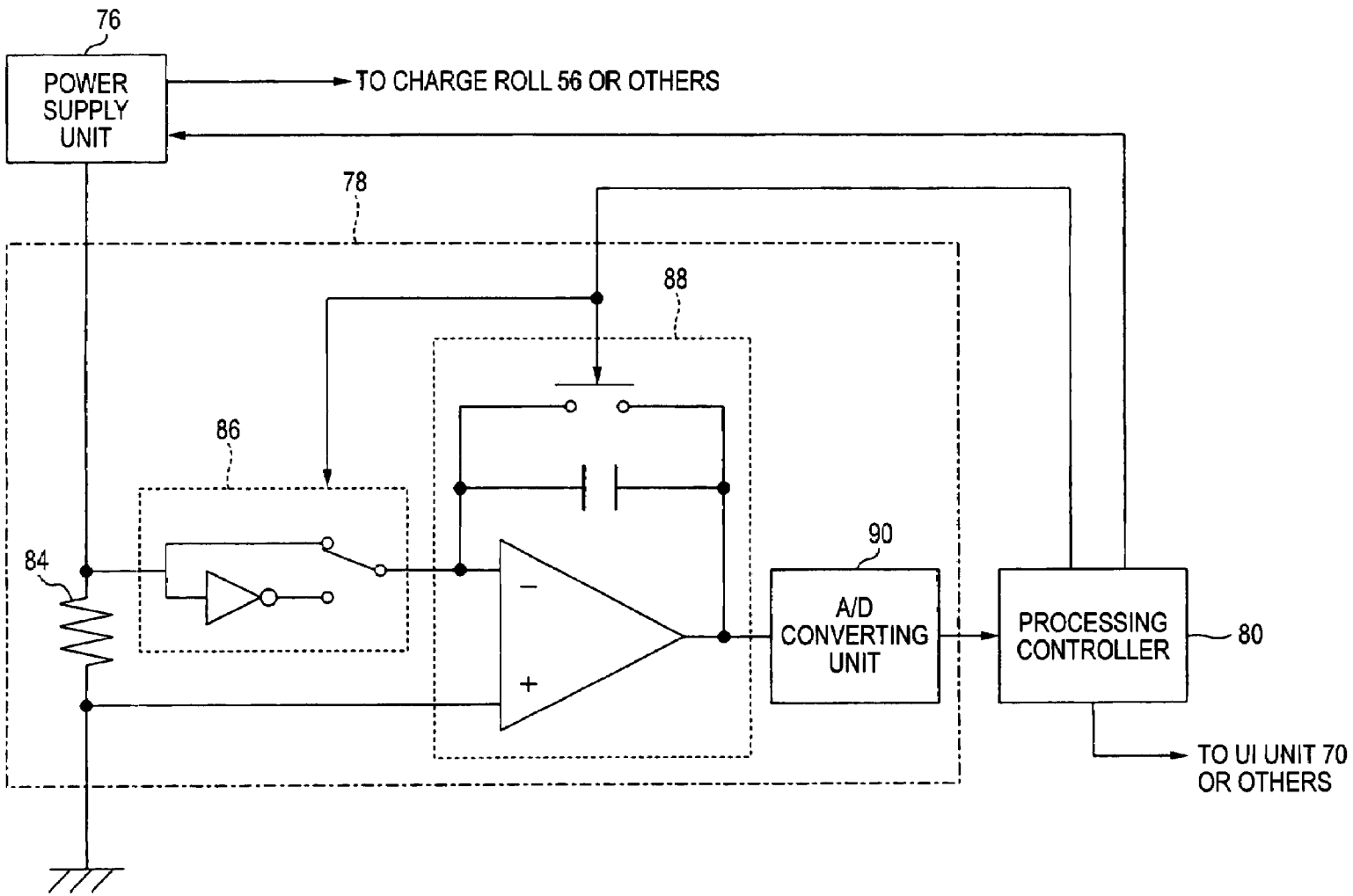
FIG. 3 is a block diagram showing details of a total charge amount detecting unit and its periphery.

FIG. 3 is a block diagram showing details of the total charge amount detecting unit 78 and its periphery.

As shown in FIG. 3, the total charge amount detecting unit 78 includes a current-voltage conversion resistor 84, a polarity inverting unit 86, a multiplying unit 88, and an A/D converting unit 90.

The current-voltage conversion resistor 84 is provided between the power supply unit 76 and ground to convert current output from the power supply unit 76 to the charger roll 56 or the like into voltage. The polarity inverting unit 86 inverts the polarity of the voltage generated by the current-voltage conversion resistor 84 in response to control by the processing controller 80 and outputs the resulting voltage to the multiplying unit 88. The multiplying unit 88 receives the voltage generated by the current-voltage conversion resistor 84 through the polarity inversion unit 86, carries out multiplication in response to control by the processing controller 80, and outputs the result to the A/D converting unit 90. The A/D converting unit 90 converts the analog voltage value input from the multiplying unit 88 into a digital value for output to the processing controller 80.

In this way, the total charge amount detecting unit 78 multiplies the voltage value in response to the current output by the power supply unit 76, so that the voltage value corresponding to the total amount of charge output by the power supply unit 76 is detected.

Note that the value output by the total charge amount detecting unit 78 maybe identified by the processing controller 80 as a value corresponding to the total amount of charge output by the power supply unit 76, so that the total charge amount detecting unit 78 may indicate the total amount of charge output by the power supply unit 76 as another value such as a current value.

Now, the process of how the image forming apparatus 10 calculates the thickness of the photosensitive layer 74 will be described.

Figure 4:
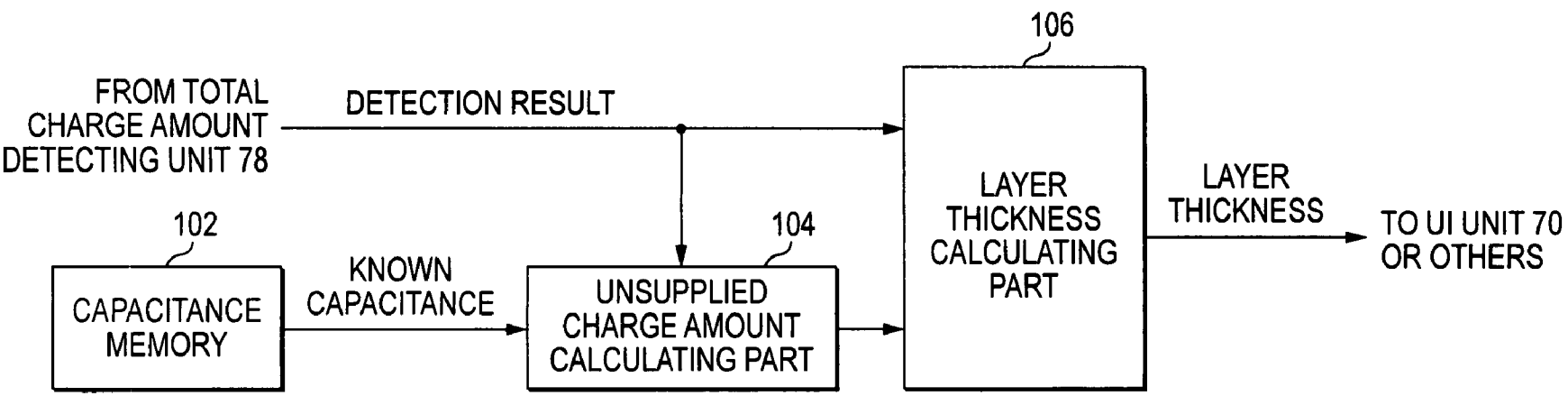
FIG. 4 is a diagram for use in illustrating the structure of a layer thickness calculating program carried out by a processing controller to calculate the thickness of a photosensitive layer.

FIG. 4 is a diagram of the structure of a layer thickness calculating program 100 carried out by the processing controller 80 to calculate the thickness of the photosensitive layer 74.

As shown in FIG. 4, the layer thickness calculating program 100 includes a capacitance memory 102, an unsupplied charge amount calculating part 104, and a layer thickness calculating part 106.

The capacitance memory 102 pre-stores the known capacitance of the capacitive load 82 and outputs the known capacitance to the unsupplied charge amount calculating part 104 when the layer thickness calculating program 100 is carried out.

The unsupplied charge amount calculating part 104 receives a voltage value corresponding to the total amount of charge output by the power supply unit 76 as a detection result from the total charge amount detecting unit 78, receives the known capacitance of the capacitive load 82 from the capacitance memory 102, and calculates the amount of charge output by the power supply unit 76 and not supplied to the charger roll 56. The part outputs the unsupplied charge amount to the layer thickness calculating part 106 and also stores it.

The unsupplied charge amount calculating part 104 may calculate the unsupplied charge amount based on results of the total charge amounts output by the power supply unit 76 to charge the two image carriers 44*a* and 44*b* provided with photosensitive layers 74 having known and different thikensses and detected by the total charge amount detecting unit 78.

The layer thickness calculating part 106 receives a voltage value corresponding to the total amount of charge output by the power supply unit 76 from the total charge amount detecting unit 78 as a detection result, receives an unsupplied charge amount calculated by the unsupplied charge amount calculating part 104, and calculates a charge amount supplied to the charger roll 56 according to (1):

$$Q1=Q0-Q2 \quad (1)$$

where Q0 is the total amount of charge output by the power supply unit 76, Q1 is a charge amount supplied to the charger roll 56, and Q2 is an unsupplied charge amount calculated by the unsupplied charge amount calculating part 104.

The layer thickness calculating part 106 calculates the thickness d of the photosensitive layer 74 according to (2) based on the charge amount Q1 supplied to the charger roll 56 and outputs the result of calculation to the UI unit 70 or the like.

$$d=\epsilon_0\cdot\epsilon\cdot l\cdot D\cdot\pi\cdot V/Q1 \quad (2)$$

where $\epsilon_0$ is the vacuum permittivity, $\epsilon$ is the relative dielectric constant of the photosensitive layer 74, l is the charge effective length of the image carrier 44, D is the diameter of the photosensitive layer 74 (that substantially equals the outer diameter of the drum 72), V is voltage applied by the power supply unit 76, and Q1 is the amount of charge supplied to the charger roll 56.

The layer thickness calculating part 106 may calculate the thickness of the photosensitive layer 74 based on a voltage value corresponding to the total amount of charge output by the power supply unit 76 and an unsupplied charge amount detected by the method described later. The unsupplied charge amount value stored in the unsupplied charge amount calculating part 104 may be used at this time.

Figure 5:
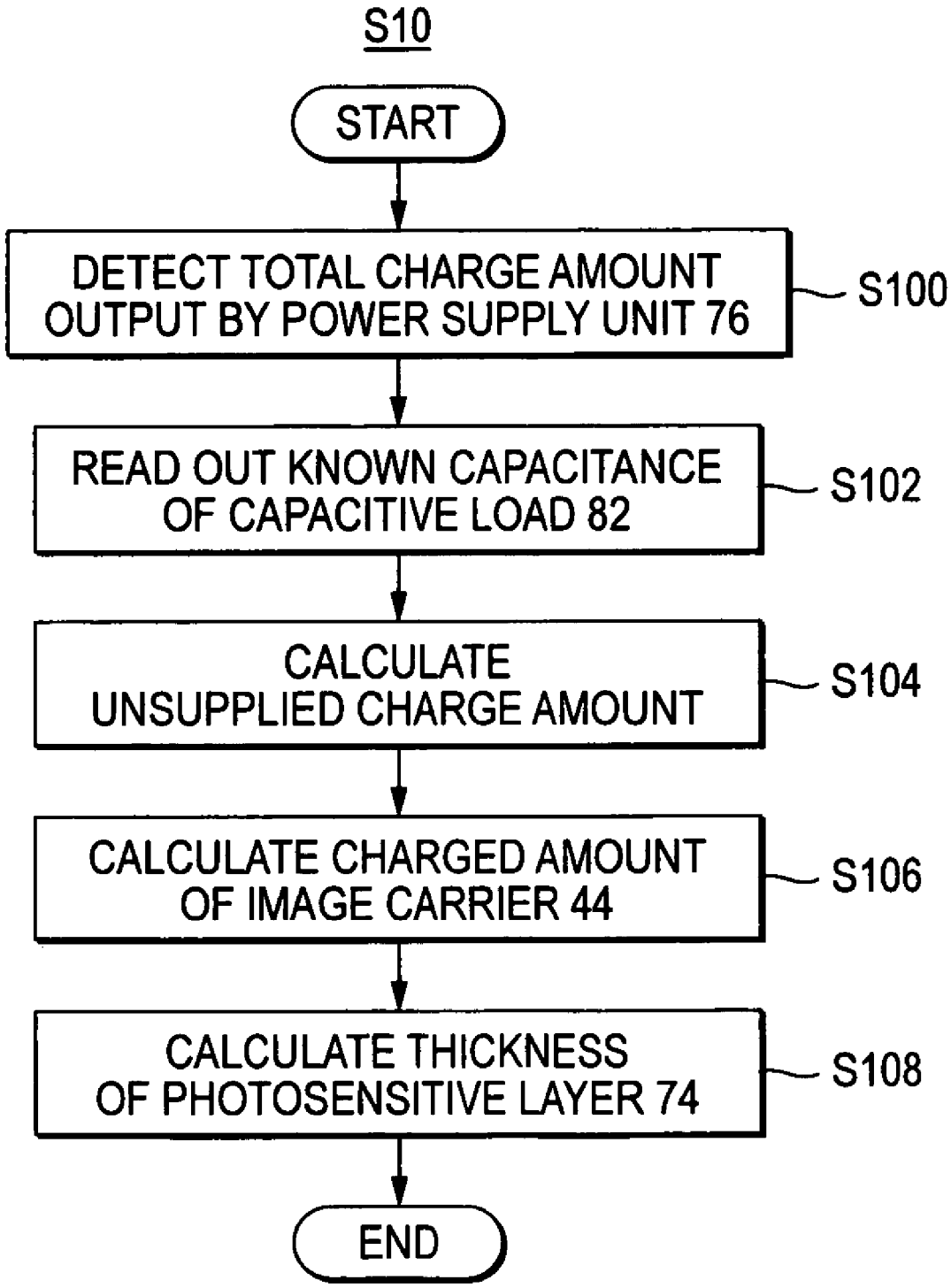
FIG. 5 is a flowchart for use in illustrating the step of calculating the thickness of the photosensitive layer (S10) by the image forming apparatus.

FIG. 5 is a flowchart for use in illustrating the step of calculating the thickness of the photosensitive layer 74 (S10) carried out by the image forming apparatus 10.

As shown in FIG. 5, in step 100 (S100), the total charge amount detecting unit 78 detects the total charge amount Q0 output by the power supply unit 76.

In step 102 (S102), the unsupplied charge amount calculating part 104 reads out the known capacitance of the capacitive load 82 from the capacitance memory 102.

In step 104 (S104), the unsupplied charge amount calculating part 104 calculates an unsupplied charge amount Q2.

In step 106 (S106), the layer thickness calculating part 106 calculates the charge amount of the charged image carrier 44 (the charge amount Q1 supplied to the charger roll 56).

In step 108 (S108), the layer thickness calculating part 106 calculates the thickness d of the photosensitive layer 74.

In this way, the processing controller 80 subtracts the unsupplied charge amount Q2 calculated by the unsupplied charge amount calculating part 104 from the total charge amount Q0 output by the power supply unit 76, so that the thickness d of the photosensitive layer 74 can accurately be calculated.

Now, another method of calculating the thickness d of the photosensitive layer 74 will be described.

Figure 6:
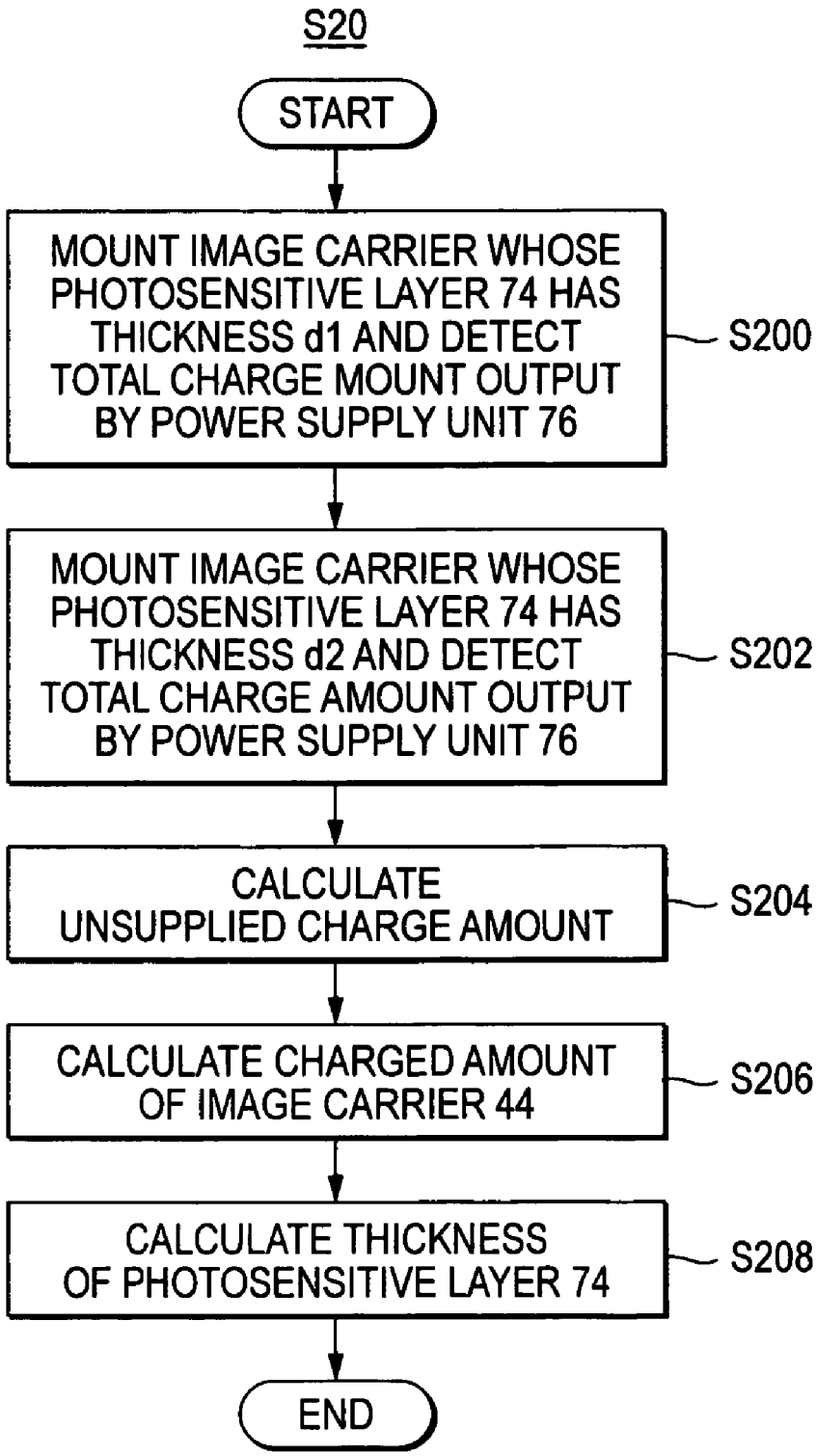
FIG. 6 is a flowchart for use in illustrating a first method of calculating the thickness of the photosensitive layer (S20)

FIG. 6 is a flowchart for use in illustrating a first method of calculating the thickness of the photosensitive layer 74 (S20).

As shown in FIG. 6, in step 200 (S200), when the image forming apparatus 10 is provided with an image carrier 44*a* in which the thickness of the photosensitive layer 74 is known as d1 and the capacitance of the photosensitive layer 74 is known as C1, the total charge amount detecting unit 78 detects the total amount of charge Qa (a corresponding voltage value) output by the power supply unit 76 to charge the image carrier 44*a*.

In steps 202 (S202), when the image forming apparatus 10 is provided with an image carrier 44*b* in which the thickness of the photosensitive layer 74 is known as d2 and the capacitance of the photosensitive layer 74 is known as C2, the total charge amount detecting unit 78 detects the total amount of charge Qb (a corresponding voltage value) output by the power supply unit 76 to charge the image carrier 44*b*.

Figure 7:
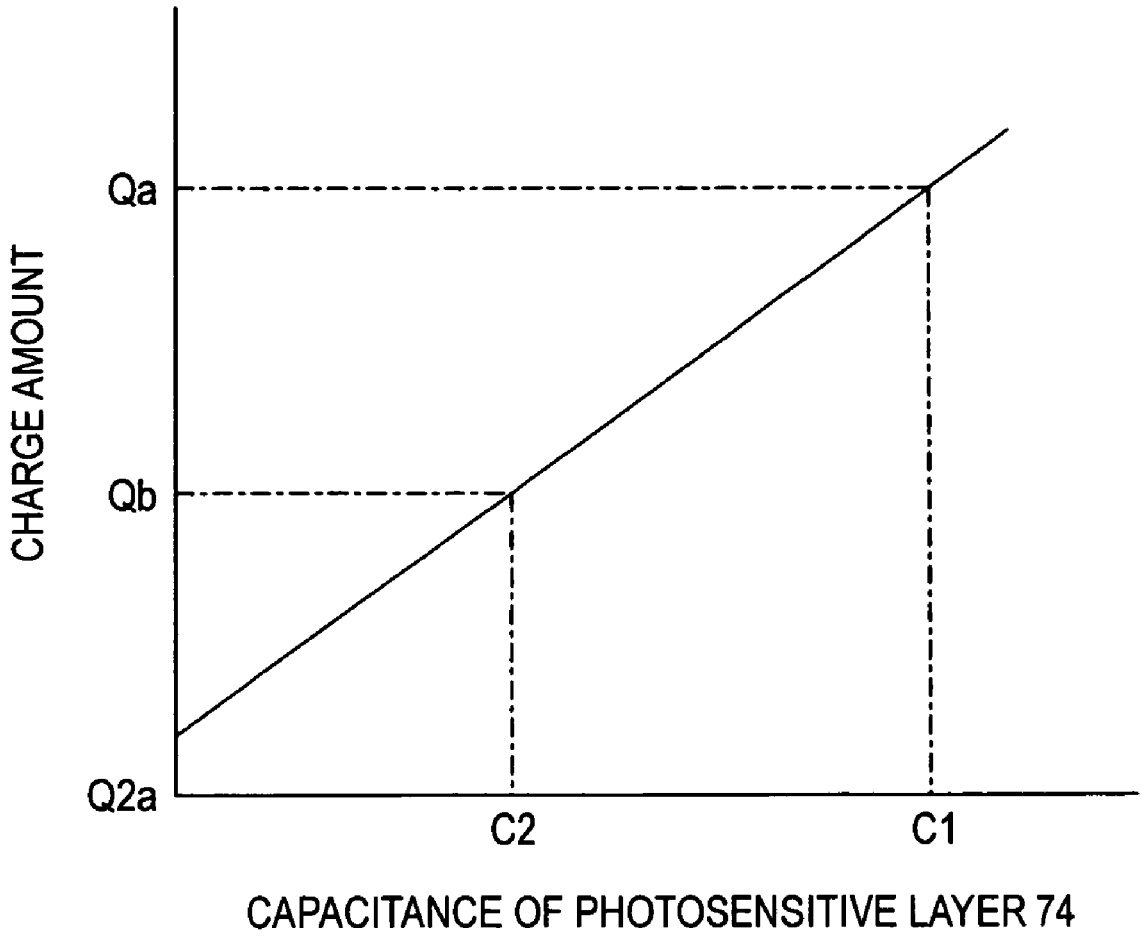
FIG. 7 is a graph showing a method of how to calculate the intercept Q2*a* where the capacitance of the photosensitive layer is zero, based on the difference between the total charge amounts Qa and Qb which corresponds to the difference between the capacitances C1 and C2.

In step 204 (S204), using the results of processing in steps S200 and S202, the unsupplied charge amount calculating part 104 calculates the intercept Q2*a* as the unsupplied charge amount, which is where the capacitance of the photosensitive layer 74 is zero. This calculation is based on the difference between the total charge amount Qa and the total charge amount Qb relative to the difference between the capacitance C1 and the capacitance C2 as shown in the graph in FIG. 7.

In step 206 (S206), the layer thickness calculating part 106 calculates the charged amount of the image carrier 44 (the charge amount supplied to the charger roll 56).

In step 208 (S208), the layer thickness calculating part 106 calculates the thickness d of the photosensitive layer 74.

The processing controller 80 may calculate the intercept Q2*a* as the unsupplied charge amount, which is where the capacitance of the photosensitive layer 74 is zero based on the ratio between the initial value of the capacitance of the photosensitive layer 74 and the value after change in the image carrier 44.

Figure 8:
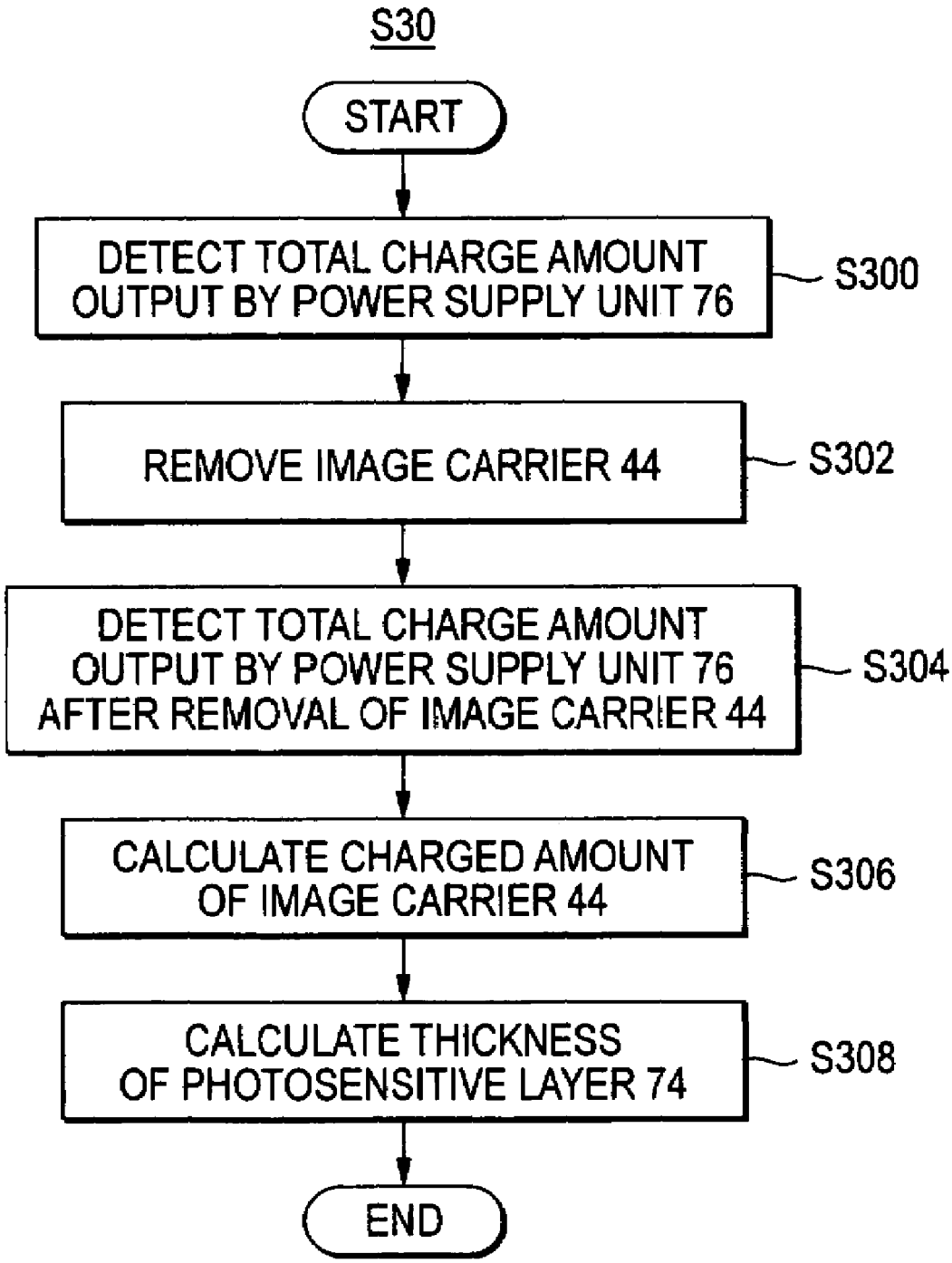
FIG. 8 is a flowchart for use in illustrating a second method of calculating the thickness of the photosensitive layer (S30)

FIG. 8 is a flowchart for use in illustrating a second method of calculating the thickness of the photosensitive layer 74 (S30).

As shown in FIG. 8, in step 300 (S300), the total charge detecting unit 78 detects the total amount of charge Q0 output by the power supply unit 76.

In step 302 (S302), the image carrier 44 is removed from the image forming apparatus 10.

In step 304 (S304), the total charge amount detecting unit 78 detects the total amount of charge output by the power supply unit 76 as the unsupplied charge amount Q2*b* after the image carrier 44 is removed.

Figure 9:
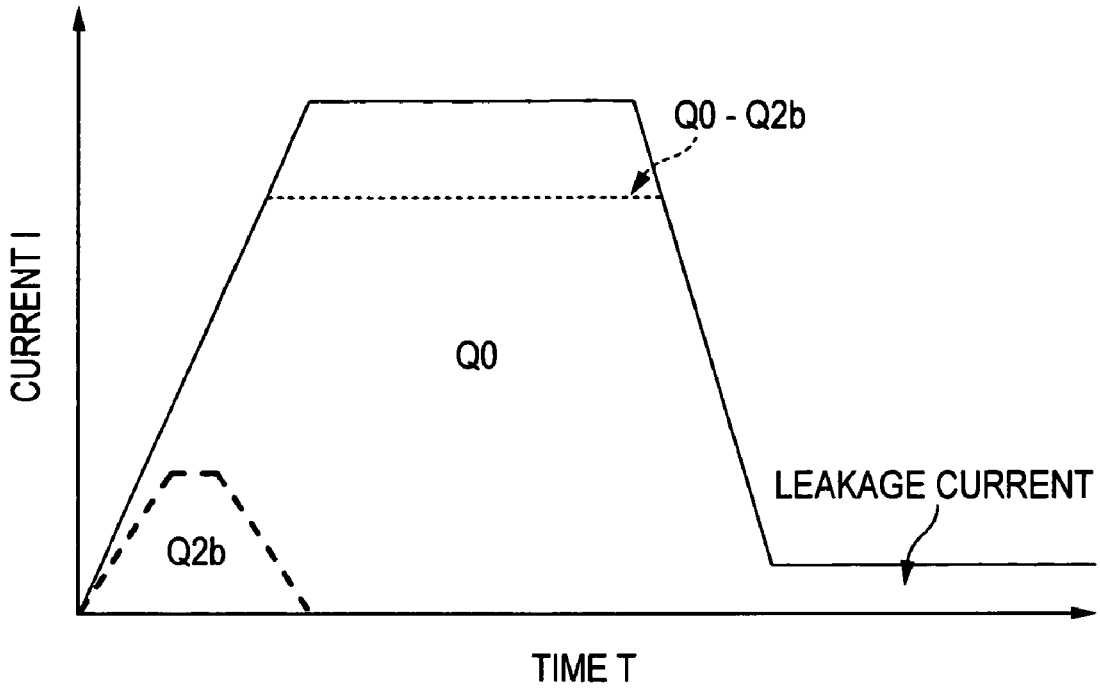
FIG. 9 is a graph showing a method of how to calculate the charged amount of an image carrier (the amount of charge supplied to a charger roll) by subtracting an unsupplied charge amount Q2*b* from a detected total charge amount Q0.

In step 306(S306), as shown in FIG. 9, the layer thickness calculating part 106 calculates the charged amount of the image carrier 44 (the amount of charge supplied to the charger roll 56) by subtracting the total charge amount Q2*b* detected in step S304 (unsupplied charge amount) from the total charge amount Q0 detected in step S300.

In step 308 (S308), the layer thickness calculating part 106 calculates the thickness d of the photosensitive layer 74.

The processing controller 80 may invert the polarity of the voltage multiplied by the multiplying unit 88 by the polarity inverting unit 86 after the image carrier 44 is charged, so that leakage current for time equal to the time required for charging the image carrier 44 may be calculated, and thus the charged amount of the image carrier 44 exclusive of the leakage current may be calculated.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art understand the invention for various embodiments and with the various modifications as are suited to the particular use contemplated. It is intended that the scope of the invention be defined by the following claims and their equivalents.

What is claimed is:

1. An image forming apparatus, comprising:

an image carrier that carries a developer image by a charge layer provided on a surface of the image carrier;

a charger that charges the image carrier;

a feeder that feeds the charger with a charge;

a total charge amount detector that detects a total amount of the charge output by the feeder;

an unsupplied charge amount calculator that calculates an amount of the charge output by the feeder but not supplied to the charger; and a layer thickness calculator that calculates a thickness of the charge layer based on the unsupplied charge amount calculated by the unsupplied charge amount calculator and the total charge amount detected by the total charge amount detector.

2. The image forming apparatus according to claim 1, wherein the unsupplied charge amount calculator calculates the unsupplied charge amount based on the capacitance between the feeder and the charger and the voltage output by the feeder.

3. A method of calculating the thickness of a charge layer provided on a surface of an image carrier, wherein the image carrier is charged by a charger to carry a developer image, the method comprising:

detecting a total amount of charge output by a feeder that feeds the charger with a charge;

calculating an amount of the charge output by the feeder but not supplied to the charger; and calculating a thickness of the charge layer based on the total charge amount and the unsupplied charge amount.

4. The layer thickness calculating method according to claim 3, wherein the unsupplied charge amount is calculated based on the capacitance between the feeder and the charger and the voltage output by the feeder.

5. The layer thickness calculating method according to claim 3, wherein the unsupplied charge amount is calculated based on the total amount of the charge output by the feeder to charge a plurality of image carriers wherein each image carrier is comprised of a layer that has a known but unique thickness.

6. A method of calculating the thickness of a charge layer provided on a surface of an image carrier charged by a charger to carry a developer image, the method comprising:

detecting a total amount of charge output by a feeder that feeds the charger with a charge;

detecting an amount of the charge output by the feeder but not supplied to the charger; and calculating a thickness of the charge layer based on the total charge amount and the unsupplied charge amount.

7. The layer thickness calculating method according to claim 6, wherein the unsupplied charge amount is detected by detecting the total amount of the charge output by the feeder while the image carrier is removed.

* * * * *